US007886921B2

(12) United States Patent
Long

(10) Patent No.: US 7,886,921 B2
(45) Date of Patent: Feb. 15, 2011

(54) CLOSURE

(75) Inventor: Charles J. Long, New Castle, PA (US)

(73) Assignee: International Plastics and Equipment Corp., New Castle, PA (US)

( * ) Notice: Subject to any disclaimer, the term of this patent is extended or adjusted under 35 U.S.C. 154(b) by 1100 days.

(21) Appl. No.: 11/636,766

(22) Filed: Dec. 11, 2006

(65) Prior Publication Data

US 2008/0135512 A1 Jun. 12, 2008

(51) Int. Cl.
*B65D 39/00* (2006.01)
*B65D 47/36* (2006.01)

(52) U.S. Cl. ..... 215/253; 220/266

(58) Field of Classification Search ..... 220/266; 215/253; 222/525
See application file for complete search history.

(56) References Cited

U.S. PATENT DOCUMENTS 5,222,530 A 6/1993 Baker et al.
5,232,125 A 8/1993 Adams
5,273,083 A 12/1993 Burrows
5,284,188 A * 2/1994 Baker et al. ..... 141/18
5,295,518 A * 3/1994 Baker et al. ..... 141/18
5,370,270 A 12/1994 Adams et al.
5,687,865 A * 11/1997 Adams et al. ..... 215/253
2006/0201905 A1 9/2006 Perrin et al.

FOREIGN PATENT DOCUMENTS

WO WO 02/060808 A1 8/2002

OTHER PUBLICATIONS

U.S. Appl. No. 60/787,871, Charles J. Long, Jr., et al.

* cited by examiner

*Primary Examiner*—Anthony Stashick
*Assistant Examiner*—James N Smalley
(74) *Attorney, Agent, or Firm*—Eckert Seamans Cherin & Mellott, LLC; Stephen A. Bucchianeri, Esq.

(57) ABSTRACT

The invention generally relates to a closure having a cap coupled to a sleeve defining a frangible connection between the cap and the sleeve. A preselected geometry is provided between the cap and the sleeve proximate to the frangible connection which allows for formation of a clean break between the cap and the sleeve when the cap is broken away from the sleeve. An extended bead is also provided with consistent material distribution on the bead proximate to a juncture of the cap to the sleeve after the cap is broken away from the sleeve. A projection is additionally provided on the cap which projects at an angle. The projection has a generally tapering leg of reduced thickness that terminates in a vertical wall segment. The projection also has the bead that is formed located on an outer corner of the projection after the frangible connection is broken.

19 Claims, 7 Drawing Sheets

CLOSURE

FIELD OF THE INVENTION

The invention generally relates to a closure and, more particularly, to a closure for a container.

BACKGROUND INFORMATION

A closure is usually coupled to the neck of a container that contains liquid. The closure is used for closing the mouth of the container that is typically placed in a downwards position resting on a liquid dispenser with a feed tube inserted into the container. A prior art closure has a cap coupled to a sleeve. The prior art closure is opened by inverting the container with the closure coupled thereto and inserting a feed tube into an opening of the closure which applies a relative axial force to the cap to break the cap away from the sleeve. Once the feed tube has been inserted into the container with the cap broken away from the sleeve, the inverted container is placed in a downwards position resting on the liquid dispenser and liquid is ready to be dispensed from the container since the feed tube is in fluid communication with the liquid dispenser and the broken away cap supplies an opening in the closure for the contents of the container to be flowed from the container to the feed tube into the liquid dispenser.

A problem exists with certain prior art closures having a cap and sleeve coupled thereto in that the cap does not provide for a clean break between the cap and the sleeve when the cap is broken away from the sleeve. As such, the prior art closure also do not form an extended bead with consistent material distribution on the bead proximate to a juncture of the cap to the sleeve after the cap is broken away from the sleeve. Accordingly, there is room for improvement in such closures.

SUMMARY OF THE INVENTION

An object of the invention is to provide a closure having a cap and a sleeve coupled thereto with the cap being structured to make a clean break from the sleeve when the cap is broken away from the sleeve.

An additional object of the invention is to provide a closure having a cap and a sleeve coupled thereto that is structured to form an extended bead with consistent material distribution on the bead proximate to a juncture of the cap to the sleeve after the cap is broken away from the sleeve.

Certain objects of the invention are achieved by providing a closure having a cover with a central opening disposed therein. An annular skirt is coupled to a peripheral surface of the cover and a sleeve is coupled to a peripheral edge of the central opening. A cap is coupled to the sleeve defining a frangible connection between the cap and the sleeve and a projection is provided on the cap which projects at an angle. A first segment is located proximate to the frangible connection that extends in a general horizontal direction at an angle, $\theta_1$ with respect to an axis that extends along an axial length of the closure and a second segment is located proximate to the frangible connection that extends in a general horizontal direction at an angle, $\theta_2$ with respect to the axis. The frangible connection is located proximate to an inner diameter of the sleeve proximate to one end of the sleeve with $\theta_1$ having a value of about 75 degrees to about 105 degrees and $\theta_2$ having a value of about 75 degrees to about 105 degrees.

Other objects of the invention are achieved by providing a closure having a cover with a central opening disposed therein. An annular skirt is coupled to a peripheral surface of the cover and a sleeve is coupled to a peripheral edge of the central opening. A cap is coupled to the sleeve defining a frangible connection between the cap and the sleeve and a projection provided on the cap which projects at an angle. A first segment is located proximate to the frangible connection that extends in a general horizontal direction at an angle, $\theta_1$ with respect to an axis that extends along an axial length of the closure and a second segment is located proximate to the frangible connection that extends in a general horizontal direction at an angle, $\theta_2$ with respect to the axis. The frangible connection is located proximate to an inner diameter of the sleeve proximate to one end of the sleeve and the frangible connection is broken defining a bead on an outer corner of the projection. The bead has a first extension that extends in a general vertical direction from a corner of the bead and the bead has a second extension that extends in a general horizontal direction from the corner of the bead. The projection has a generally tapering leg having an inner portion and an outer portion that extend at an angle from the axis and terminate in a vertical wall segment. The inner portion extends at an angle, $\theta_3$ with respect to the axis and the outer portion extends at an angle, $\theta_4$ with respect to the axis.

Other objects of the invention are achieved by providing a closure having a cover with a central opening disposed therein. An annular skirt is coupled to a peripheral surface of the cover and a sleeve is coupled to a peripheral edge of the central opening. A cap is coupled to the sleeve defining a frangible connection between the cap and the sleeve and a projection is provided on the cap which projects at an angle. A first segment is located proximate to the frangible connection that extends in a general horizontal direction at an angle, $\theta_1$ with respect to an axis that extends along an axial length of the closure and a second segment is located proximate to the frangible connection that extends in a general horizontal direction at an angle, $\theta_2$ with respect to the axis. The frangible connection is located proximate to an inner diameter of the sleeve proximate to one end of the sleeve and the frangible connection is broken defining a bead on an outer corner of the projection. The bead has a first extension that extends in a general vertical direction from a corner of the bead and the bead has a second extension that extends in a general horizontal direction from the corner of the bead. The projection has a generally tapering leg having an inner portion and an outer portion that extend at an angle from the axis. The inner portion extends at an angle, $\theta_3$ with respect to the axis, the outer portion extends at an angle, $\theta_4$ with respect to the axis and the generally tapering leg has a first thickness. The cap has a wall extending from one end of the cap and the wall has a second thickness at about a midpoint of the wall. The first thickness and the second thickness form a ratio of about 0.2 to about 0.3.

DETAILED DESCRIPTION OF THE PREFERRED EMBODIMENTS

Figure 1:
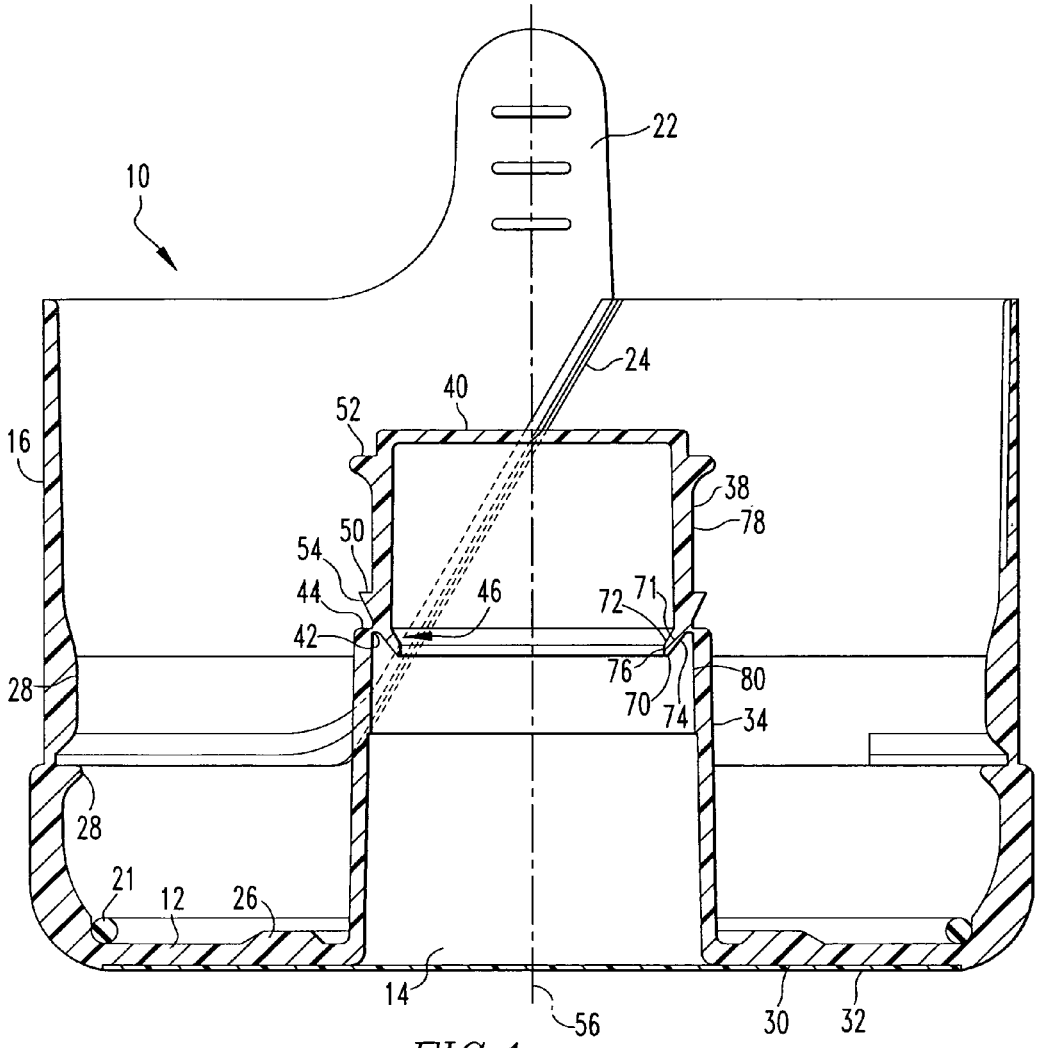
FIG. 1 is a side cross-sectional view of a closure of the invention.
Figure 2:
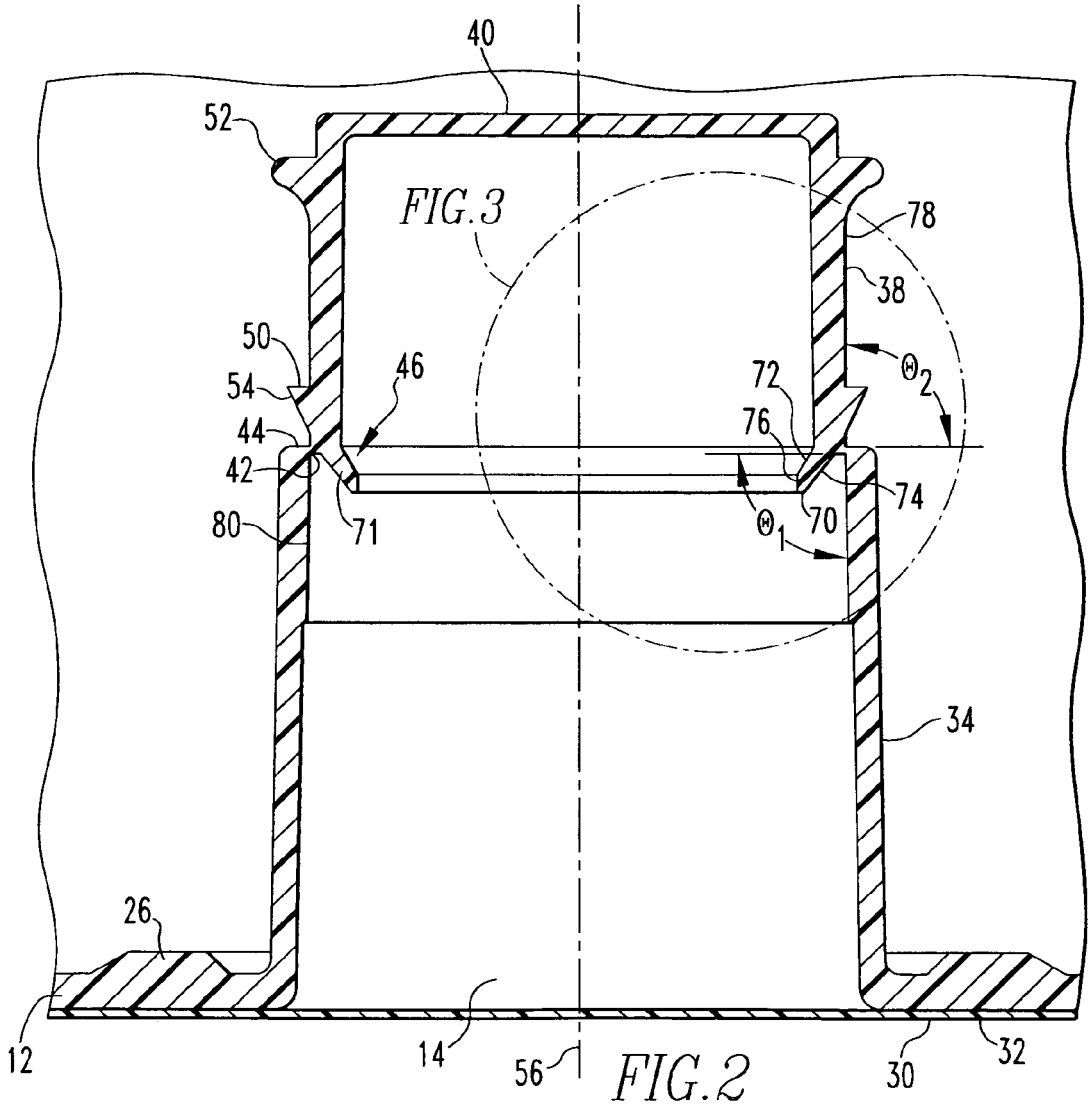
FIG. 2 is an enlarged cross-sectional view of the closure shown in FIG. 1.

For purposes of the description hereinafter, the terms "upper", "lower", "vertical", "horizontal", "axial", "top", "bottom", "aft", "behind", and derivatives thereof shall relate to the invention as it is oriented in the drawing FIGS. or as it is oriented when coupled to a container resting downwards in an operational relationship with a liquid dispenser that is resting on a flat horizontal surface. However, it is to be understood that the invention may assume various alternative configurations when the invention is moved about or the container is resting in storage in an upwards relationship. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

As employed herein, the term "number" shall mean one or to an integer greater than one (i.e., a plurality). As employed herein, the statement that two or more parts are "attached", "connected", "coupled", or "engaged" together shall mean that the parts are joined together either directly or joined through one or more intermediate parts.

Figure 4:
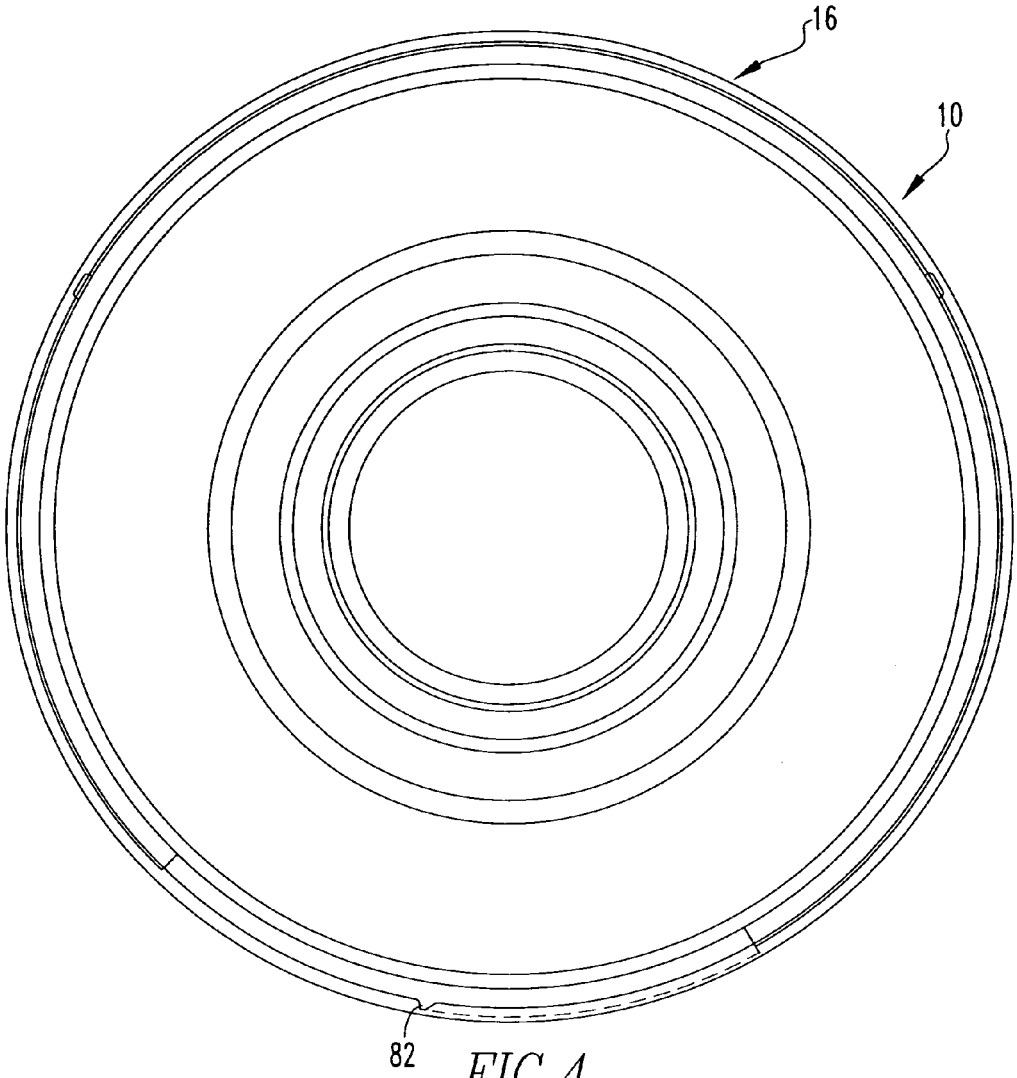
FIG. 4 is an enlarged top plan view of the closure shown in FIG. 1 showing vertical tear strips of the invention.
Figure 5:
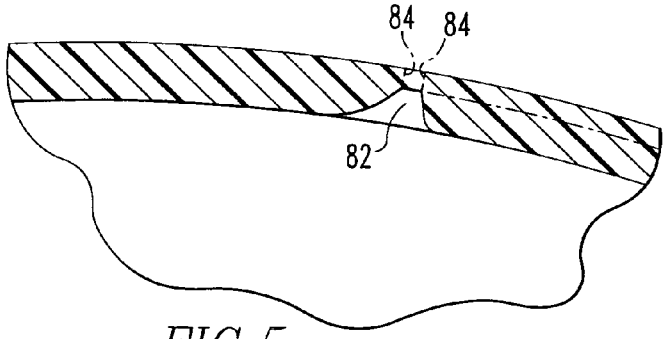
FIG. 5 is an enlarged cross-sectional view of the vertical tear strips shown in FIG. 4.
Figure 6:
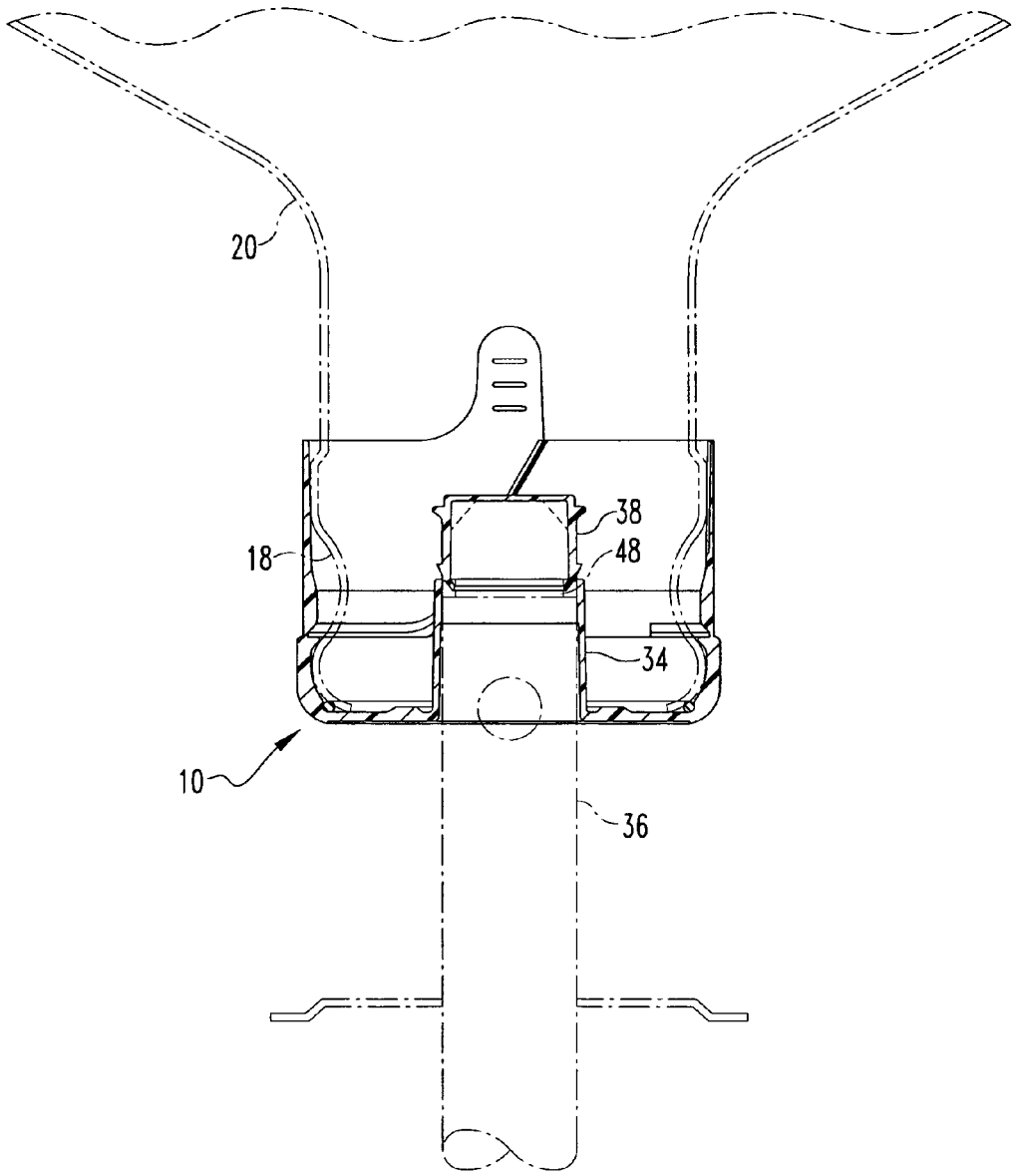
FIG. 6 is a schematic view of the neck of a container provided with the closure shown in FIG. 1, during installation of a feed tube coupled to a liquid dispenser just before breaking the frangible connection.
Figure 7:
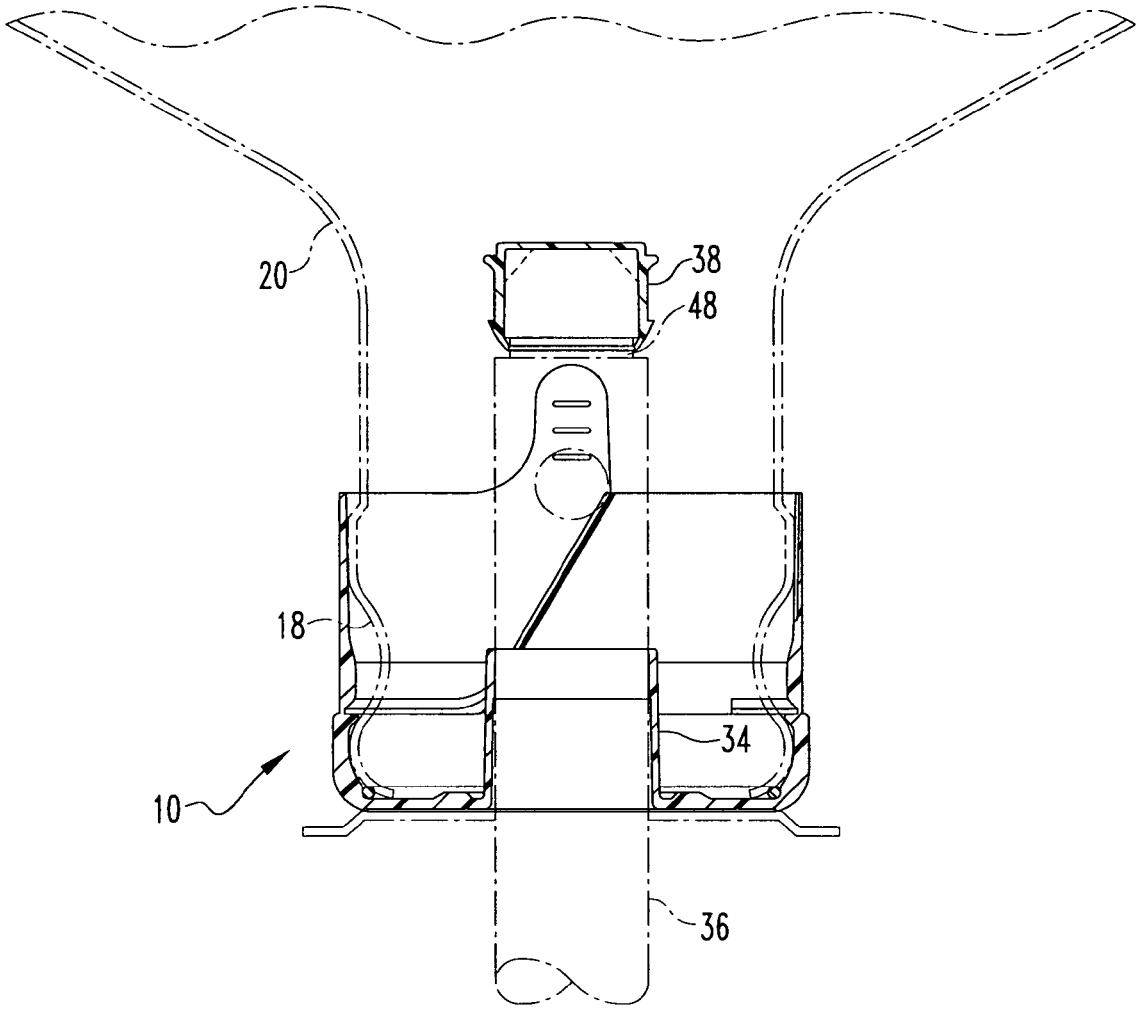
FIG. 7 is a view similar to FIG. 6, showing the neck of the container and the closure coupled thereto once the feed tube of the liquid dispenser is inserted within the container.
Figure 8:
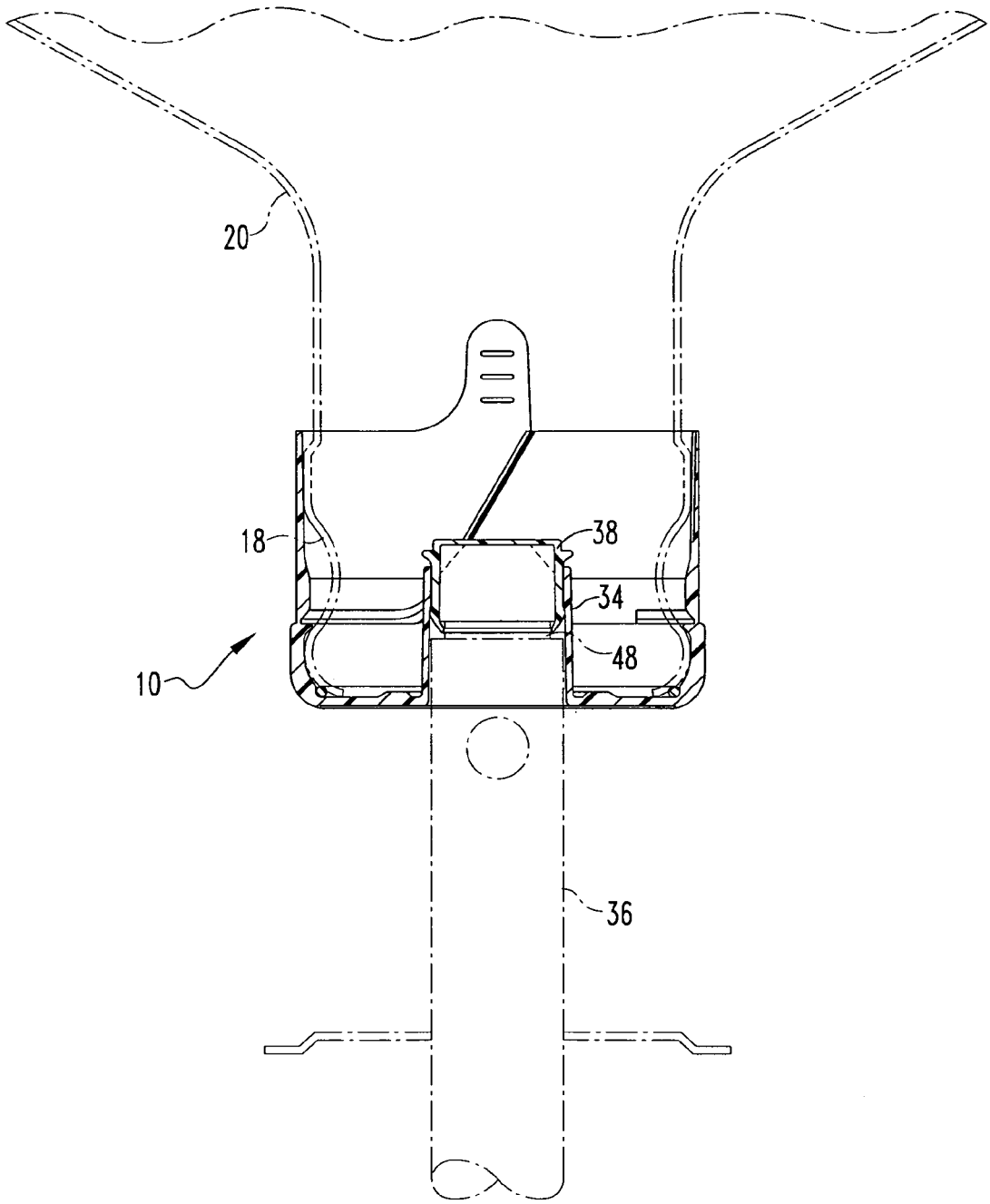
FIG. 8 is a view similar to FIGS. 6 and 7, showing the manner in which the cap is forced back within the sleeve of the closure by the feed tube when the feed tube of the liquid dispenser is removed from the container.

Turning to FIGS. 1-8, a closure 10 of the invention is shown. The closure 10 is typically used for closing the mouth of a container structured for placement in a downwards position on a liquid dispenser. The closure 10 has a round shaped cover 12, which is provided with a central opening 14 which is also round shaped. An annular skirt 16 integrally connected to a peripheral surface of the cover 12 extends in an axial direction from the peripheral surface of the cover 12. The skirt 16 is structured to be coupled to a neck 18 of a container 20 as is shown in FIGS. 6-8.

An elastomeric member 21 may be placed on an internal surface of the closure 10 and an internal surface of the cover 12 at a location proximate to the juncture of the peripheral surface of the cover 12 to the skirt 16. The elastomeric member 21 is structured to couple the cover 12 to the container 20 in order to provide liquid tightness of the closure 10 with the container 20 and maintain hygienic properties of the container 20.

With reference to FIG. 1, the skirt 16 has a tab 22 which is coupled to a frangible band 24 formed in the skirt 16. The frangible band 24 is structured to be broken by applying a pulling force on the tab 22 which facilitates removal of the closure 10 from the neck 18 of the container 20. The frangible band 24 has a horizontal portion extending along the skirt 16 which is structured to be broken approximately one half of the length of the entire circumference of the skirt 16 by applying a pulling force on the tab 22.

The internal surface of the cover 12 may be provided with a round shaped ridge 26. The ridge 26 is disposed on the internal surface of the closure 10, is coaxial with the opening 14 and is located proximate to the opening 14. The internal surface of the skirt 16 may be provided with a number of ribs 28. The ribs 28 provided on the internal surface of the skirt 16 are structured to couple the skirt 16 with the container 20 in order to provide liquid tightness of the closure 10 with the container 20 and maintain hygienic properties of the container 20.

The external surface of the cover 12 of the closure 10 may also be provided with a recess 30 structured for receiving a removable seal 32 whose purpose is to protect against the introduction of contaminants within the closure 10 through the central opening 14, provide a level of assurance to the consumer that the closure 10 has not been contaminated and allow readable identification by the consumer of the liquid source that is used and of the identity of the company which has manufactured or filled the container 20. The removable seal 32 may be glued to the cover 12, thermoplastically adhered to the cover 12 or coupled to the cover 12 with other suitable coupling means.

The closure 10 also has a sleeve 34 in the form of a cylindrical annular body integrally connected to the central opening 14 that extends from a peripheral edge of the central opening 14 in the same direction as the skirt 16 and coaxially with the skirt 16. In operation and as shown in FIG. 6, the central opening 14 and the sleeve 34 surrounding the central opening 14 are both sized to receive and guide the feed tube 36 of the liquid dispenser into the container 20.

A cap 38 is integrally connected to the sleeve 34 and extends from one end of the sleeve 34 in the same direction as the skirt 16 and coaxially with the skirt 16. The cap 38 has one end 40 that is closed which extends in a general horizontal direction. When the cap 38 is separated from the sleeve 34 by the feed tube 36 of a liquid dispenser, the cap 38 then has an open end opposite to the one end 40. The cap 38 is frangibly coupled to the sleeve 34 by a frangible connection 42 located proximate to an inner diameter of the sleeve 34 proximate to one end 44 of the sleeve 34.

The cap 38 acts as an obstructor to the flow of liquid from the container 20 prior to insertion of the feed tube 36 into the container 20, is coaxial with the sleeve 34 and is structured to be separated from the sleeve 34 with a relative axial force applied to the cap 38 by the feed tube 36 when the container 20 closed by the closure 10 is placed on the feed tube 36 downwards in an operational relationship with a liquid dispenser that is resting on a flat horizontal surface. The feed tube 36 applying a relative axial force to the cap 38 separates the cap 38 from the sleeve 34 at the frangible connection 42. The cap 38 is provided with an integrally connected projection 46 which projects at an angle. The projection 46 is structured to be coupled to an annular groove 48 provided proximate to an upper end of the feed tube 36.

The cap 38 also has a first protrusion 50 located proximate to the projection 46 which surrounds an outer diameter of the cap 38 and has a second protrusion 52 located proximate to the one end 40 of the cap 38. The first protrusion 50 and the second protrusion 52 are structured to be coupled to the sleeve 34 and close the sleeve 34 when the container 20 is removed from the feed tube 36 and the cap 38 is moved partially into the sleeve 34 by a consumer lifting off the container 20 from the feed tube 36. A lower edge 54 of the first protrusion 50 extends at an angle with respect to an axis 56 that extends along an axial length of the closure 10 which is structured to facilitate insertion of the cap 38 into the sleeve 34 when the consumer lifts off the container 20 from the feed tube 36. The second projection 52 acts as a stop member when the consumer lifts off the container 20 from the feed tube 36 because the second projection 52 comes into contact with the one end 44 of the sleeve 34 and halts further axial movement of the cap 38 within the sleeve 34.

FIGS. 6-8 illustrate the operation of the closure 10 when a feed tube 36 of a liquid dispenser is inserted into the container 20 which is closed by the closure 10. FIG. 6 illustrates the closure 10 during the feed tube 36 penetration step. As can be seen, the feed tube 36 matingly engages with the central opening 14 and directs the projection 46 into engagement with the annular groove 48 to thereby secure the cap 38 to the feed tube 36. FIG. 7 illustrates the closure 10 once the feed tube 36 has been inserted into the container 20 by breaking the frangible connection 42 between the sleeve 34 and the cap 38 by application of a relative axial force to the cap 38 with the feed tube 36. FIG. 8 illustrates the engagement of the cap 38 in the sleeve 34 as the cap 38 is pulled into an inner area of the sleeve 34 when the consumer lifts off the container 20 from the feed tube 36 to thereby close the closure 10 when the container 20 is removed from the liquid dispenser.

Figure 3:
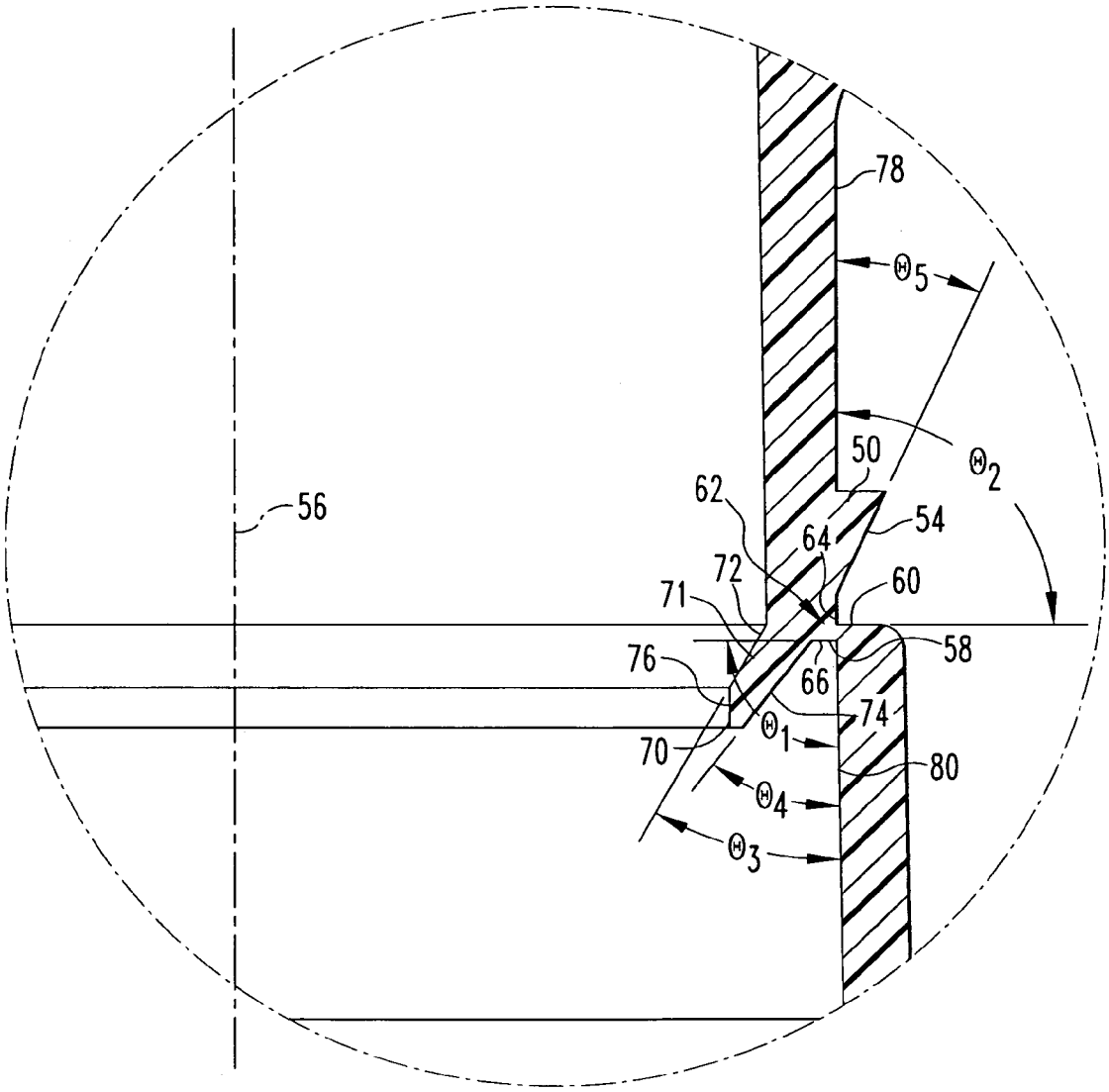
FIG. 3 is an enlarged cross-sectional view of the circled area identified as FIG. 3 in FIG. 2.

The cap 38 has a first segment 58 located proximate to the frangible connection 42 that extends in a general horizontal direction at an angle, $\theta_1$ with respect to the axis 56. As shown in FIG. 3, $\theta_1$ has a value of about 90 degrees, but may have a value from about: (i) 75 degrees to about 105 degrees; (ii) 80 degrees to about 100 degrees; (iii) 85 degrees to about 95 degrees; or (iv) 88 degrees to about 92 degrees. $\theta_1$ may also have a value that encompasses any range that falls within the range from about 75 degrees to about 105 degrees such as, for example, the ranges enumerated in the preceding sentence.

The sleeve 34 has a second segment 60 located proximate to the frangible connection 42 that extends in a general horizontal direction at an angle, $\theta_2$ with respect to the axis 56. As shown in FIG. 3, $\theta_2$ has a value of about 90 degrees, but may have a value from about: (i) 75 degrees to about 105 degrees; (ii) 80 degrees to about 100 degrees; (iii) 85 degrees to about 95 degrees; or (iv) 88 degrees to about 92 degrees. $\theta_2$ may also have a value that encompasses any range that falls within the range from about 75 degrees to about 105 degrees such as, for example, the ranges enumerated in the preceding sentence.

The geometry of $\theta_1$ and $\theta_2$ is structured to allow the frangible connection 42 to break in a general vertical direction between $\theta_1$ and $\theta_2$ when the feed tube 36 is inserted into the container 20 which applies a relative axial force to the cap 38. The general vertical break at the frangible connection 42 provides an extended bead 62 on an outer corner of the projection 46 which stiffens the cap 38 and the projection 46. The bead 62 is defined by a first extension 64 that extends in a general vertical direction along the cap 38 from a corner of the bead 62 and a second extension 66 that extends in a general horizontal direction from the corner of the bead 62 towards leg 71.

The geometry of $\theta_1$ and $\theta_2$ is structured to allow the frangible connection 42 to provide for a clean generally vertical break between $\theta_1$ and $\theta_2$ when the feed tube 36 is inserted into the container 20 and provide for consistent material distribution at the bead 62 on the corner of the projection 46. The bead 62, clean break and consistent material distribution are structured to assist in coupling the projection 46 of the cap 38 to the annular groove 48 of the feed tube 36.

The stiffness supplied to the projection 46 from the bead 62 allows the projection 46 to be made thinner while maintaining the robustness of the projection 46 and the intended engagement of the projection 46 with the annular groove 48. The cap 38 has a second end 70 located at an end opposite to the first end 40 which terminates with the projection 46. The projection 46 has a generally tapering leg 71 having an inner portion 72 and an outer portion 74 that extend at an angle from the axis 56 and terminate in a vertical wall segment 76.

The inner portion 72 extends from the cap 38 at an angle, $\theta_3$ with respect to the axis 56. As shown in FIG. 3, $\theta_3$ has a value of about 30 degrees, but may have a value from about 25 degrees to about 35 degrees. $\theta_3$ may also have a value that encompasses any range that falls within the range from about 25 degrees to about 35 degrees.

The outer portion 74 extends from the cap 38 at an angle, $\theta_4$ with respect to the axis 56. As shown in FIG. 3, $\theta_4$ has a value of about 38 degrees, but may have a value from about 30 degrees to about 45 degrees. $\theta_4$ may also have a value that encompasses any range that falls within the range from about 30 degrees to about 45 degrees.

Due to the extended bead 62 on an outer corner of the projection 46 which stiffens the cap 38 and projection 46, a thinner generally tapering leg 71 of the projection 46 may be used. The leg 71 has a reduced first thickness of about 0.022 inch (0.56 mm) which is relatively thinner when compared to a second thickness of the wall 78 extending from the one end 40 of the cap 38 which is about 0.085 inch (2.16 mm). The second thickness of the wall 78 of the cap 38 was measured at about a midpiont of the wall 78 where the first projection 50 and the second projection 52 are absent from the wall 78 of the cap 38. The ratio of the first thickness of the leg 71 to the second thickness of the wall 78 is about 0.26, but may have a value from about 0.20 to about 0.30. The ratio may also have a value that encompasses any range that falls within the range from about 0.20 to about 0.30.

A lower edge 54 of the first protrusion 50 extends at an angle, $\theta_5$ with respect to the axis 56. As shown in FIG. 3, $\theta_5$ has a value of about 25 degrees, but may have a value from about 15 degrees to about 35 degrees. $\theta_5$ may also have a value that encompasses any range that falls within the range from about 15 degrees to about 35 degrees. The angle, $\theta_5$ of the lower edge 54 is structured to facilitate insertion of the cap 38 into the sleeve 34 when the consumer lifts off the container 20 from the feed tube 36.

A rib 80 may be provided on the sleeve 34 on its inner diameter proximate to the one end 44 thereof. The rib 80 would assist in coupling the sleeve 34 to the feed tube 36 when the feed tube 36 penetrates the central opening 14. The rib 80 could also facilitate insertion of the cap 38 into the sleeve 34 by providing alignment of the cap 38 with the sleeve 34 during removal of the feed tube 36 when the consumer lifts off the container 20 from the feed tube 36.

With reference to FIGS. 4-5, the closure 10 may also have a number of vertical tear strips 82 formed in the skirt 16. The vertical tear strips 82 have a number of tear bands 84 associated therewith. If someone were to attempt to pry off the closure 10 from the container 20 with a screwdriver, mechanical object or the like in an effort to introduce contaminants into the container 20 without damaging the skirt 16, the tear bands 84 would fracture and a portion of the material of the closure 10 would separate from the skirt 16 due to the force applied to the skirt 16 from the mechanical object used to pry off the closure 10. The fracture of the tear bands 84 would visually demonstrate that the closure 10 had been tampered with and that the contents of the container 20 should not be consumed due to the risk of possible contamination.

The entire closure 10 including the cover 12, the skirt 16, the sleeve 34 and the cap 38 and all the other elements that are components of such elements are molded in one single piece, without having to add additional components by welding, gluing or other combination of pieces. The one-piece closure 10 mold avoids potential sources of contamination that may occur when the closure is, for example, manufactured from two or more pieces that must be stocked and handled before being assembled. The one-piece closure 10 mold also allows the closure 10 to be manufactured in any desired color, which is not practically possible when the closure 10 is made of several pieces of plastic material that must be assembled by welding, gluing or by any other means.

Due to the cap 38 being frangible at the one end 44 of the sleeve 34, the cap 38 is insertable within the same sleeve 34. As such, the closure 10 allows for removal of the container 20 from the liquid dispenser even when the container 20 is not fully empty. Such a removal may be required for cleaning the liquid dispenser or for any other maintenance that is needed. Also, the closure 10 allows for return of the container 20 to the bottler while protecting it against contaminants.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A closure comprising:

a cover with a central opening disposed therein;

an annular skirt coupled to a peripheral surface of the cover;

a sleeve coupled to a peripheral edge of the central opening;

a cap coupled to the sleeve which defines a frangible connection between the cap and the sleeve;

a projection provided on the cap which projects at an angle from the frangible connection;

a first segment located proximate to the frangible connection that extends in a general horizontal direction at an angle, $\theta_1$ with respect to an axis that extends along an axial length of the closure;

a second segment located proximate to the frangible connection that extends in a general horizontal direction at an angle, $\theta_2$ with respect to the axis; and a first protrusion provided on the cap and extending from the frangible connection, wherein the frangible connection is located proximate to an inner diameter of the sleeve proximate to one end of the sleeve, wherein $\theta_1$ has a value of about 75 degrees to about 105 degrees, and wherein $\theta_2$ has a value of about 75 degrees to about 105 degrees.

2. The closure of claim 1 wherein the frangible connection is broken and defines a bead on an outer corner of the projection, wherein the bead has a first extension that extends in a general vertical direction from a corner of the bead, and wherein the bead has a second extension that extends in a general horizontal direction from the corner of the bead.

3. The closure of claim 2 wherein the frangible connection is broken clean with a consistent material distribution at the bead.

4. The closure of claim 1 wherein the projection has a generally tapering leg having an inner portion and an outer portion that extend at an angle from the axis and terminate in a vertical wall segment, wherein the inner portion extends at an angle, $\theta_3$ with respect to the axis, wherein the outer portion extends at an angle, $\theta_4$ with respect to the axis, wherein $\theta_3$ has a value of about 25 degrees to about 35 degrees, wherein $\theta_4$ has a value of about 30 degrees to about 45 degrees, and wherein $\theta_3$ is less than $\theta_4$.

5. The closure of claim 1 wherein the projection has a generally tapering leg of a first thickness proximate an end of the projection, wherein the cap has a wall extending from one end of the cap, wherein the wall has a second thickness at about a midpoint of the wall, and wherein the first thickness and the second thickness form a ratio of about 0.2 to about 0.3.

6. The closure of claim 1 further comprising a number of vertical tear strips formed in the skirt, wherein the vertical tear strips have a number of tear bands associated therewith, and wherein the tear bands are structured to fracture and separate from the skirt in response to a force applied to the skirt by an object in an effort to remove the closure from a container.

7. The closure of claim 1 wherein the closure is manufactured in a single piece.

8. The closure of claim 1 further comprising:

a second protrusion provided on the cap located proximate to one end of the cap, wherein the first protrusion and the second protrusion are structured to be coupled to the sleeve when a container is removed from a feed tube of a liquid dispenser.

9. The closure of claim 8 wherein the first protrusion has a lower edge that extends at an angle, $\theta_5$ with respect to the axis, and wherein $\theta_5$ has a value of about 15 degrees to about 35 degrees.

10. The closure of claim 1 in combination with a container.

11. The closure of claim 1 further comprising a rib provided on the sleeve on an inner diameter of the sleeve proximate to the one end of the sleeve, and wherein the rib is structured to couple the sleeve to a feed tube of a liquid dispenser.

12. The closure of claim 1 wherein an external surface of the cover has a recess with a removable seal disposed therein.

13. The closure of claim 1 further comprising a number of ribs provided on an internal surface of the skirt which are structured to couple the skirt with a container.

14. The closure of claim 1 further comprising an elastomeric member placed on an internal surface of the cover at a location proximate to a juncture of the peripheral surface of the cover with the skirt, wherein the elastomeric member is structured to couple the cover with a container.

15. The closure of claim 1 further comprising a tab provided on the skirt coupled to a frangible band, wherein the frangible band is structured to be broken by applying a pulling force on the tab.

16. A closure comprising:

a cover with a central opening disposed therein;

an annular skirt coupled to a peripheral surface of the cover;

a sleeve coupled to a peripheral edge of the central opening;

a cap coupled to the sleeve which defines a frangible connection between the cap and the sleeve;

a projection provided on the cap which projects at an angle from the frangible connection;

a first segment located proximate to the frangible connection that extends in a general horizontal direction at an angle, $\theta_1$ with respect to an axis that extends along an axial length of the closure;

a second segment located proximate to the frangible connection that extends in a general horizontal direction at an angle, $\theta_2$ with respect to the axis; and a first protrusion provided on the cap and extending from the frangible connection, wherein the frangible connection is located proximate to an inner diameter of the sleeve proximate to one end of the sleeve, wherein the frangible connection is broken and defines a bead on an outer corner of the projection, wherein the bead has a first extension that extends in a general vertical direction from a corner of the bead, wherein the bead has a second extension that extends in a general horizontal direction from the corner of the bead, wherein the projection has a generally tapering leg having an inner portion and an outer portion that extend at an angle from the axis and terminate in a vertical wall segment, wherein the inner portion extends at an angle, $\theta_3$ with respect to the axis, and wherein the outer portion extends at an angle, $\theta_4$ with respect to the axis.

17. The closure of claim 16 wherein $\theta_1$ has a value of about 75 degrees to about 105 degrees, wherein $\theta_2$ has a value of about 75 degrees to about 105 degrees, wherein $\theta_3$ has a value of about 25 degrees to about 35 degrees, and wherein $\theta_4$ has a value of about 30 degrees to about 45 degrees.

18. The closure of claim 16 wherein the frangible connection is broken clean with a consistent material distribution at the bead.

19. The closure of claim 16 wherein the generally tapering leg has a first thickness proximate an end of the projection, wherein the cap has a wall extending from one end of the cap, wherein the wall has a second thickness at about a midpoint of the wall, and wherein the first thickness and the second thickness form a ratio of about 0.2 to about 0.3.

* * * * *

UNITED STATES PATENT AND TRADEMARK OFFICE

CERTIFICATE OF CORRECTION

PATENT NO. : 7,886,921 B2
APPLICATION NO. : 11/636766
DATED : February 15, 2011
INVENTOR(S) : Charles J. Long It is certified that error appears in the above-identified patent and that said Letters Patent is hereby corrected as shown below:

Column 1, line 30, “closure” should read --closures--.
Column 6, line 17, “midpiont” should read --midpoint--.

Signed and Sealed this
Twenty-third Day of October, 2012

David J. Kappos

David J. Kappos
*Director of the United States Patent and Trademark Office*